US005904268A

United States Patent [19]

Daly

[11] Patent Number: 5,904,268

[45] Date of Patent: May 18, 1999

[54] MUG INCORPORATING A SIMULATED ARTIFICIAL HORIZON

[76] Inventor: Francis L. Daly, 166 Skiff Ave., R.R. 2, Box 31-H, Vineyard Haven, Mass. 02568

[21] Appl. No.: 09/111,698

[22] Filed: Jul. 8, 1998

[51] Int. Cl.[6] ..... B65D 25/04

[52] U.S. Cl. ..... 220/703; 206/457; 446/74; 220/602; 220/506

[58] Field of Search ..... 220/703, 710.5, 220/735, 592.17, 503, 504, 505, 506, 523, 527, 553, 554, 555, 602, 662; 206/457; 446/74

[56] References Cited

U.S. PATENT DOCUMENTS

| | | | |
|---|---|---|---|
| 2,419,928 | 4/1947 | Wiggin et al. . | |
| 2,470,143 | 5/1949 | Christie . | |
| 2,505,380 | 4/1950 | Blefeld | 446/74 |
| 4,932,542 | 6/1990 | Chen et al. | 446/74 |
| 5,275,277 | 1/1994 | Gallegos | 206/457 |
| 5,525,383 | 6/1996 | Witkowski | 206/457 |

*Primary Examiner*—Stephen Castellano

*Attorney, Agent, or Firm*—Terrance L. Siemens

[57] ABSTRACT

A novelty drinking mug having handle and incorporating a display simulating that of an artificial horizon instrument disposed within the floor of the mug. The floor is transparent, and encloses a fluid chamber partially filled with a colored liquid. The transparent floor of the mug has indicia simulating the scale of an actual artificial horizon instrument. A disc bearing indicia simulating that representing an aircraft in an actual artificial horizon instrument is disposed in visual alignment with the transparent floor. This disc may, in alternative embodiments, be contained within the fluid chamber or within its own chamber. The disc has an eccentrically located ballast weight, and is rotatably fixed to a pivot pin. The disc rotates relative to the mug responsive to gravity when the mug is rotated about its longitudinal axis. Indicia disposed upon the disc simulates banking. When the mug is tipped or inclined from the vertical, the upper surface of the colored liquid responds in a manner simulating the artificial horizon of the actual instrument as the indicia disposed upon the floor of the mug changes orientation relative to the upper surface of the colored liquid. Varying level of the liquid with respect to the indicia disposed upon the disc simulates climbing and diving.

8 Claims, 4 Drawing Sheets

MUG INCORPORATING A SIMULATED ARTIFICIAL HORIZON

BACKGROUND OF THE INVENTION

1. Field of the Invention

The present invention relates to novelty items, and more particularly to a utilitarian article modified to incorporate a simulated artificial horizon. The article is a drinking mug, and employs a dynamic simulation of an artificial horizon for amusing effect.

2. Description of the Prior Art

Members of the aviation fraternity are usually familiar with an artificial horizon instrument, which is an instrument advising a pilot of the attitude of an aircraft he or she is flying. The actual instrument is important because the actual horizon may be obscured for any of various reasons. The pilot of the aircraft cannot necessarily depend on his or her senses to discern the actual attitude of the aircraft, since the senses may lose effectiveness should the pilot become disoriented for any reason.

An artificial horizon instrument is therefore well known, and exists in a number of forms. These forms may include an actual instrument incorporating a gyroscope, or may be a simulated device providing a realistic display but lacking the apparatus provided in an actual instrument. U.S. Pat. Nos. 2,419,928, issued to Rinaldo E. Wiggins et al. on Apr. 29, 1947, and 2,470,143, issued to John K. Christie on May 17, 1949, represent various forms of artificial horizon instruments.

The applicant is unaware of any utilitarian device incorporating a changeable or dynamic display simulating that of an artificial horizon instrument, whether for humorous effect or for other purposes. None of the above inventions and patents, taken either singly or in combination, is seen to describe the instant invention as claimed.

SUMMARY OF THE INVENTION

The present invention incorporates a changeable or dynamic display simulating that of an artificial horizon instrument into a utilitarian object which is not inherently associated with such an instrument or even with aviation. In particular, the present invention incorporates the display into a drinking vessel, preferably in the form of a mug.

Drinking of alcoholic and other beverages is frequently a part of social events, particularly those undertaken by groups of people sharing common interests. In the case of aviation enthusiasts, an otherwise ordinary drinking vessel can be modified to incorporate a device associated with the activity forming the basis of the common interest, namely, aviation. Since all serious aviation enthusiasts, especially pilots, are highly familiar with an artificial horizon instrument, incorporation of a simulated artificial horizon display into a drinking vessel will be appreciated as providing a humorous or amusing touch to a social occasion. This effect will be all the more effective since the display responds in a realistic fashion to maneuvering of the drinking vessel similar to that of an actual artificial horizon display responding to attitude of an aircraft.

To these ends, the invention comprises a drinking vessel having a lateral wall, typically cylindrical or frustoconical, and a transparent bottom incorporating a dynamic or changeable display that is located in the transparent floor, and becomes more visible as the user hoists the vessel in a manner typical of that occurring while drinking. Hoisting the vessel essentially reproduces the effect of an aircraft while climbing, which action moves a colored body of liquid in a chamber visible at the bottom of the drinking vessel. The colored liquid has an upper surface which is distinguishable from the field of vision thereabove. Because liquid responds to gravity, the generally level upper surface of the body of colored liquid simulates an artificial horizon.

In an additional feature further simulating the effect of an actual artificial horizon instrument, the novel drinking vessel incorporates indicia simulating that representing an aircraft in an actual instrument. This indicia is disposed upon a member which is rotatably contained within the floor of the vessel. Turning or rotating the vessel will simulate banking in that the member will rotate. The indicia simulating the aircraft will then incline relative to the bottom of the vessel, and particularly with respect to the horizon line provided by the upper surface of the colored liquid. Hence the overall effect is much similar to the actual instrument simulated by the invention.

The amusing effect provided by the display, which is self-contained within the vessel, operates independently of external power or other external inputs apart from gravity. The drinking vessel remains fully functional in its ordinary capacity despite presence of the display, which responds in a realistic manner to manipulation of the vessel relative to inclining the vessel and rotating the same about its longitudinal axis.

Accordingly, it is a principal object of the invention to provide a simulated artificial horizon in a drinking vessel.

It is another object of the invention that the simulated artificial horizon have a dynamic display.

It is a further object of the invention that the simulated artificial horizon respond in generally realistic manner to manipulation of the drinking vessel.

Still another object of the invention is that the display be visible through the bottom of the drinking vessel.

An additional object of the invention is that the drinking vessel be fully functional as a drinking vessel.

It is an object of the invention that the display operate responsive to gravity.

Yet another object of the invention is that the display be self-contained and require no external power or other influence apart from gravity.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
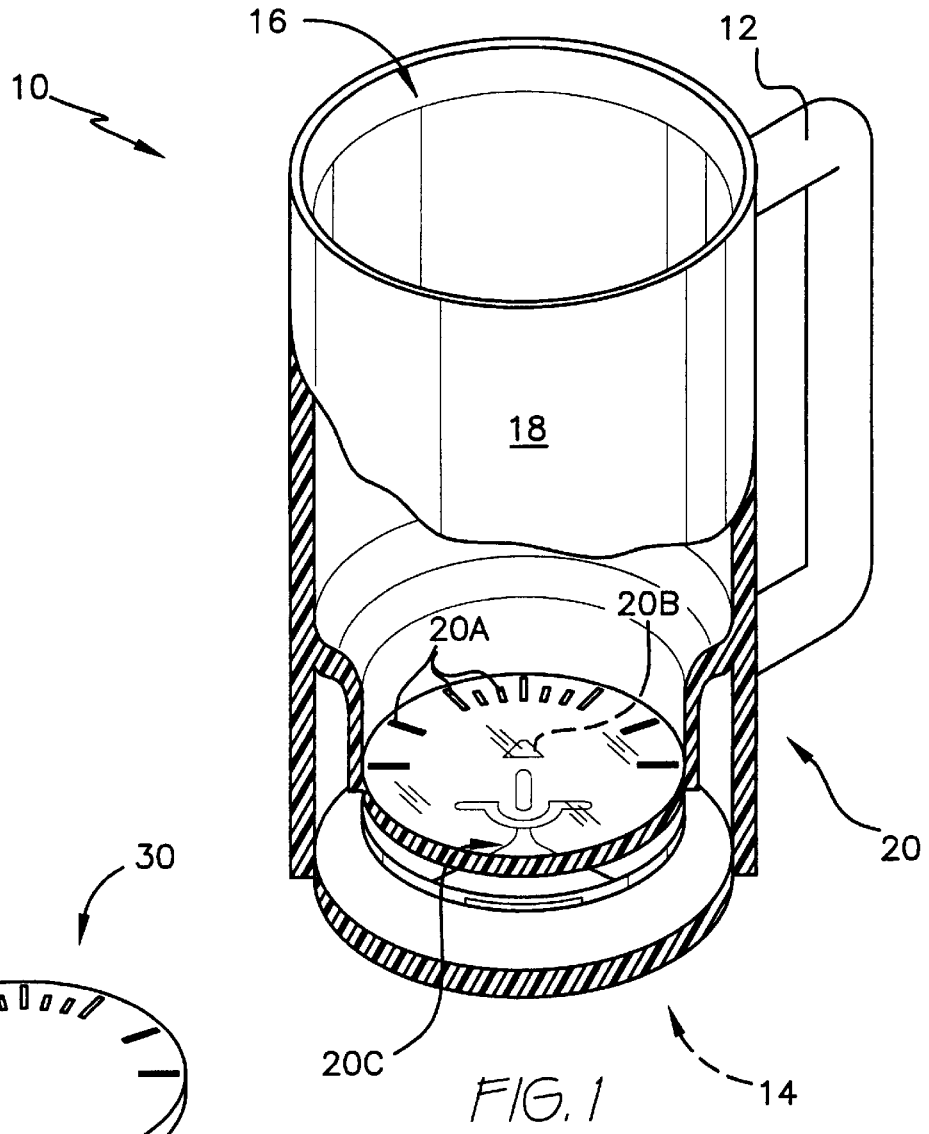
FIG. 1 is a perspective view of the invention, with some components omitted and other components partially broken away to reveal internal detail.

Turning now to FIG. 1 of the drawings, the novelty drinking vessel 10 is seen to comprise a drinking mug having a handle 12 fixed exteriorly thereto and a simulated display of an artificial horizon instrument visible through floor 14 of vessel 10. Vessel 10 comprises a liquid receptacle 16 having a lateral wall 18 and transparent floor 14. The display is readily seen when vessel 10 is empty and when vessel 10 is held so that the user can peer into liquid receptacle 16. Indicia 20A simulates the scale of an actual artificial horizon instrument, thereby providing a visual field of reference similar to that provided as part of an actual artificial horizon instrument. Indicia 20B is a pointer, and indicia 20C simulates an aircraft symbol customarily provided in the display of an actual artificial horizon instrument. Indicia 20A, 20B, 20C are visible inside liquid receptacle 16 when viewed from the open top of vessel 10.

Figure 3:
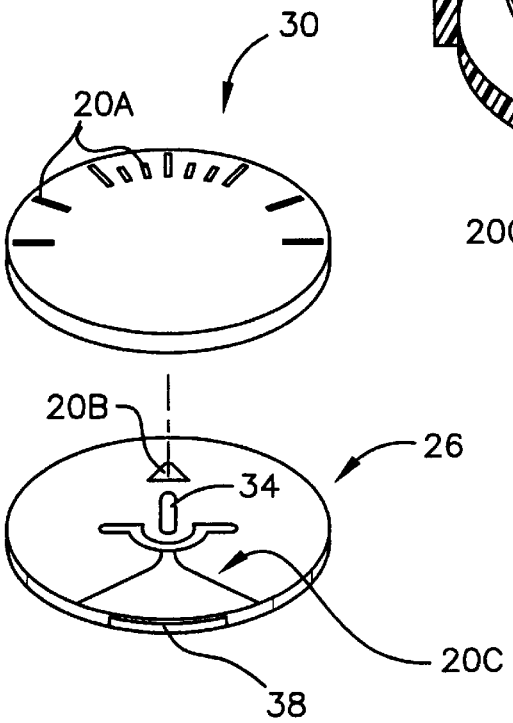
FIG. 3 is a perspective detail view of a component revealed by breaking away in FIG. 1.
Figure 2:
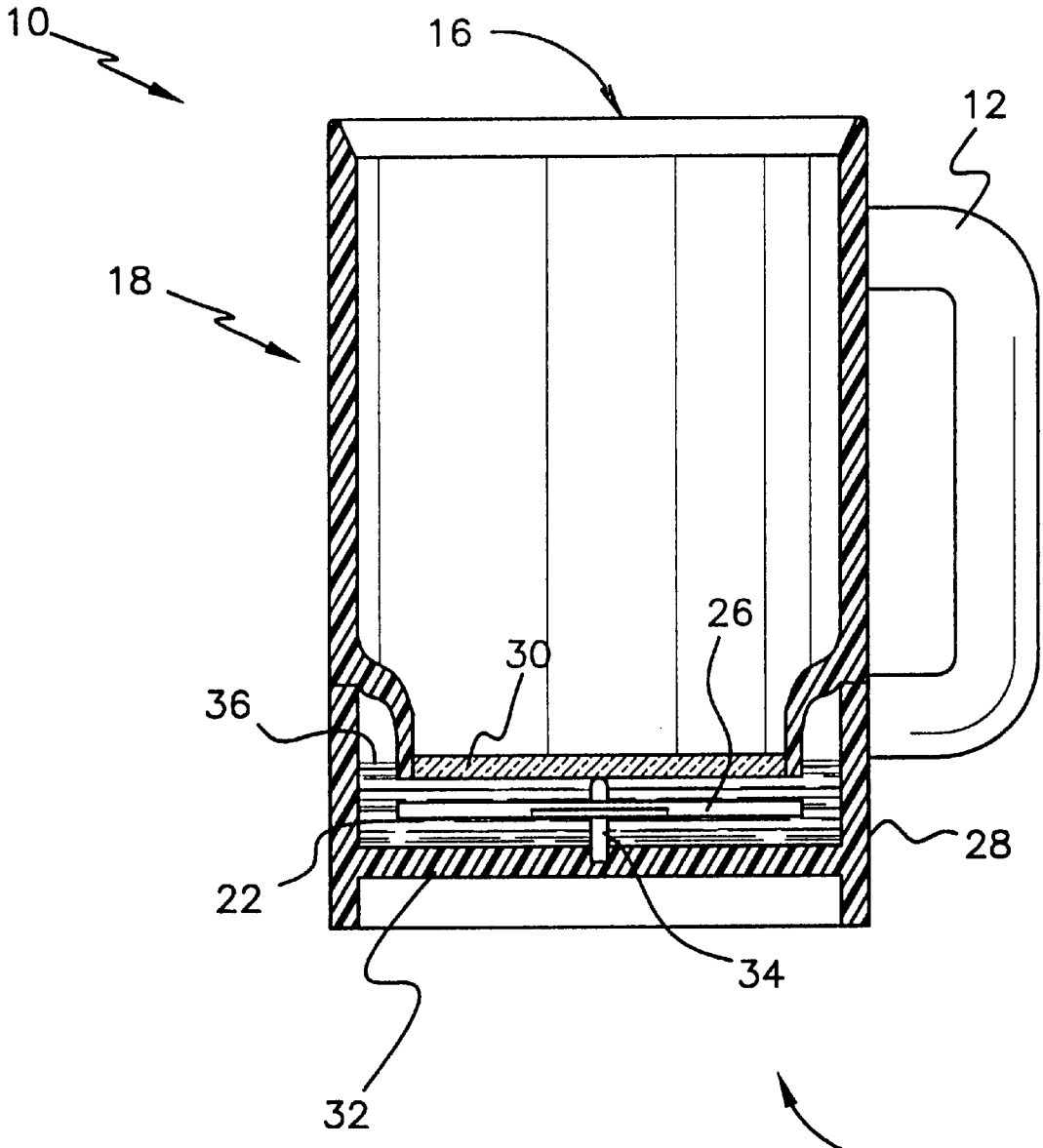
FIG. 2 is a side cross sectional view of the invention.

As seen in FIG. 2, the display is contained within a closed fluid chamber 22 disposed within the bounds of floor 14 and lateral wall 18. The display comprises, in addition to indicia 20A, 20B, 20C, a transparent solid member 26 bearing indicia 20B. Fluid chamber 22 is bounded by opaque section 28 of lateral wall 18, transparent panel 30 forming the top of fluid chamber 22, and opaque panel 32 forming the bottom of fluid chamber 22. Member 26, which bears indicia 20B and 20C, and panel 30, which bears indicia 20A, are both illustrated in FIG. 3. Member 26 is a disc rotatably contained within fluid chamber 22, supported in this position on a pivot pin 34 fixed to floor 14. Section 28 and panels 30 and 32 are dimensioned and configured to surround member 26 and to constrain member 26 to remain generally parallel to floor 14. Thus, apart from minor play due to clearance between adjacent solid components of vessel 10, member 26 can move only in rotation. As seen in FIG. 3, member 26 includes a ballast weight 38.

Figure 4:
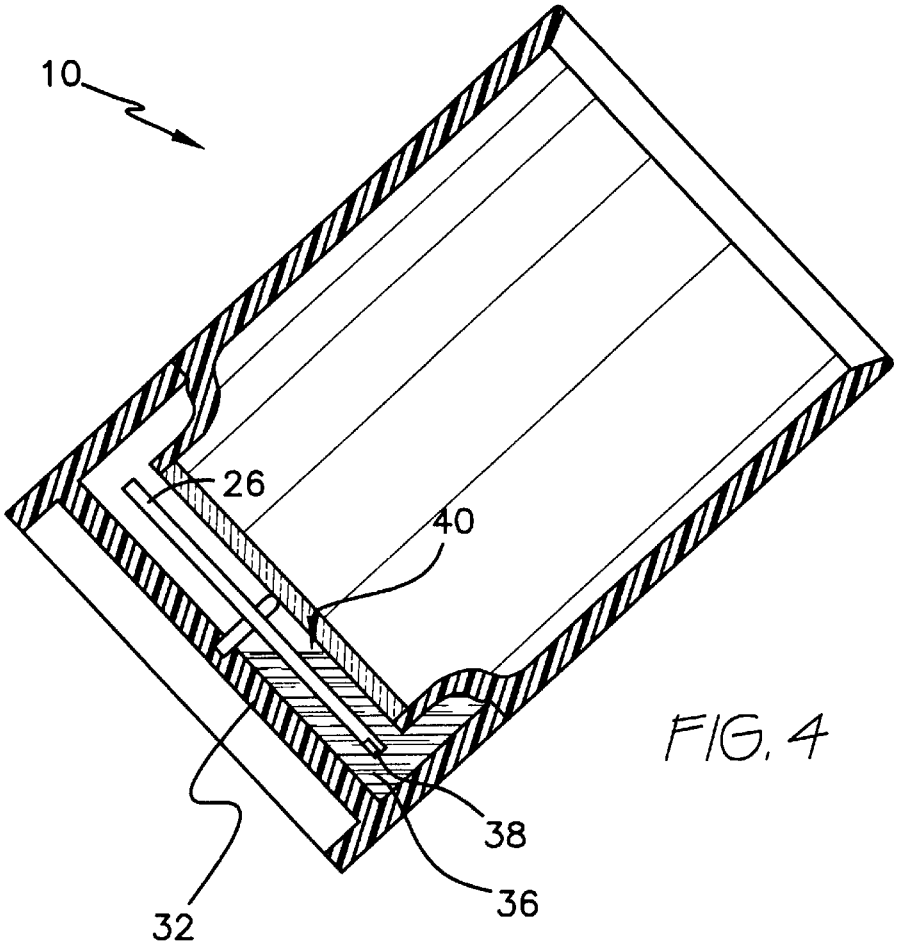
FIG. 4 is a side elevational view of the invention illustrating the effect of tipping the novel mug, shown partially in cross section.
Figure 5:
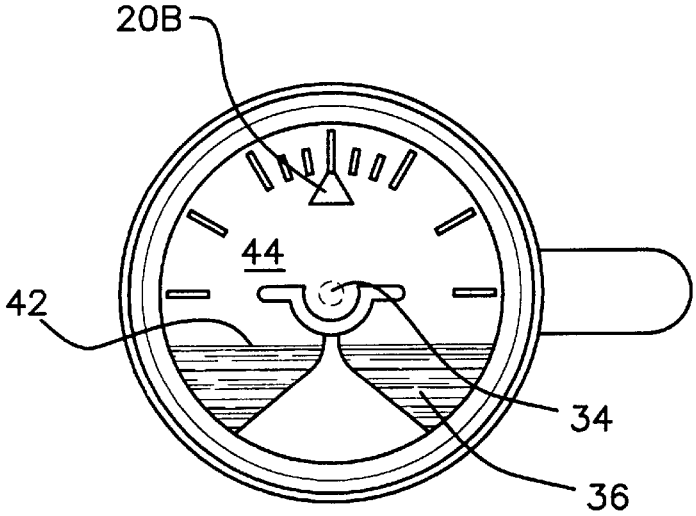
FIG. 5 is a top plan view of the invention, drawn to reflect tipping illustrated in FIG. 4.

Fluid chamber 22 is partially filled with a colored liquid 36. Referring now to FIG. 4, when vessel 10 is tipped, ballast weight 38 maintains member 26 in an upright orientation, in that pointer 20B points upwardly. Member 26 rotates responsive to the effect of gravity on ballast weight 38. The degree of inclination causes the upper surface 40 of liquid 36 to intersect panel 30 of floor 14 at different levels. This is illustrated in FIG. 5. In the depiction of FIG. 5, upper surface 40 of liquid 36 establishes a visible line 42 of demarcation between liquid 36 and the unobstructed portion 44 of floor 14 of vessel 10. This line 42 forms the artificial horizon of the display of novel vessel 10. A different degree of inclination could cause line 42 to occur at other locations on floor 14. Differing levels of line 42 represent different pitch attitudes, that is, of climb and dive, and experienced aviators will recognize the simulation achieved by vessel 10 immediately.

In addition to varying pitch, vessel 10 will register different degrees of roll, or banking left and right. Should the user tilt his head in tandem with vessel 10, then that portion of indicia 20C representing the lateral plane of the aircraft will register roll correspondingly relative to the user's vision. Notably, pointer 20B, which is disposed at or near the periphery of member 26, will point in a direction diverging from a direction the user will perceive as upward and vertical.

Pivot pin 34 does not detract from the overall effect of the display of vessel 10 since pin 34 is located so as to engage member 26 at the center point of member 26 in a location customarily occupied by indicia producing a similar visual effect as pin 34 in the actual instrument. Pivot pin 34 thus constrains member 26 to rotate about its own center.

Figure 6:
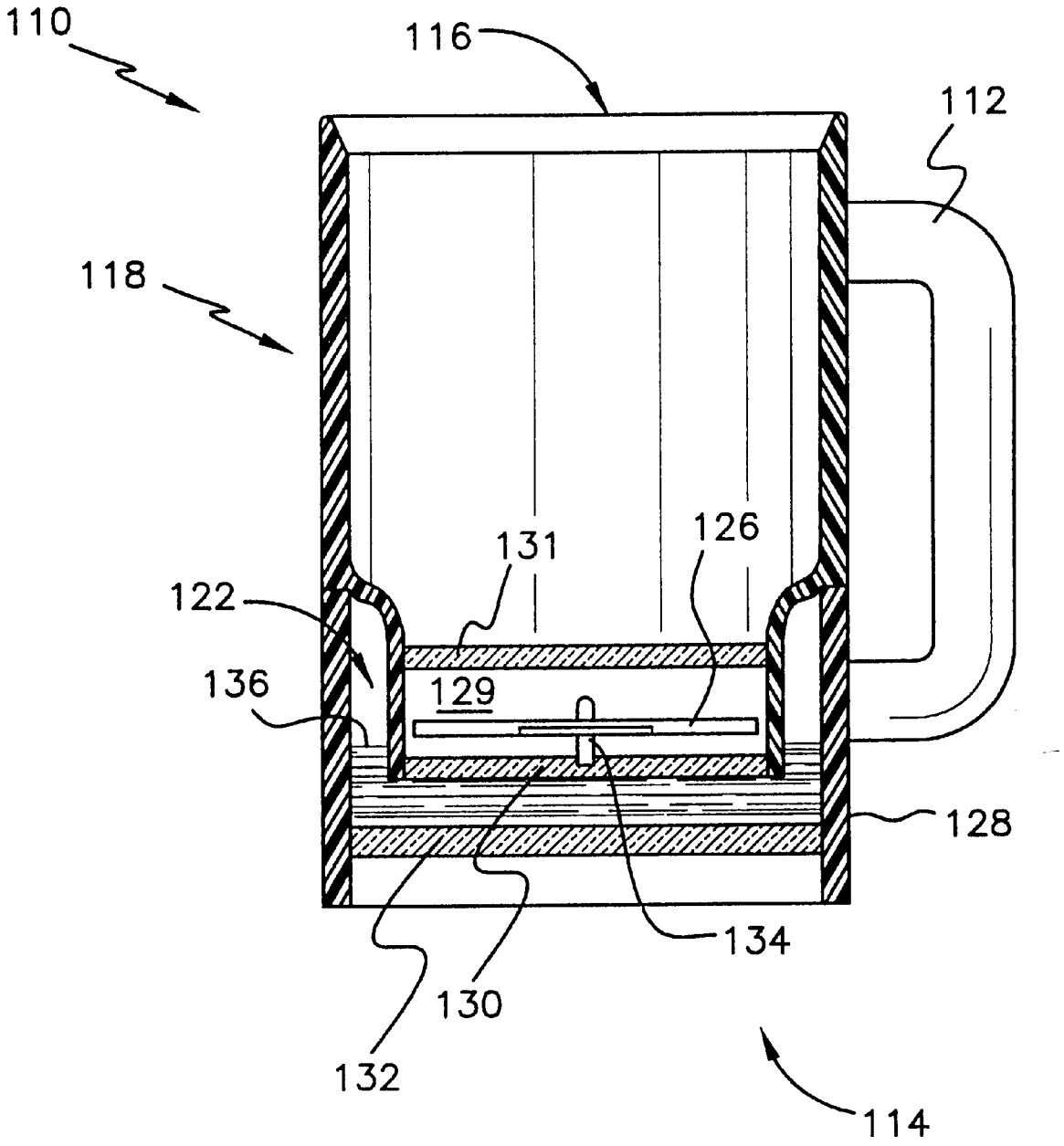
FIG. 6 is a side cross sectional view of a second embodiment of the invention.

FIG. 6 illustrates a second embodiment of the invention wherein the visual display is separate from liquid 136. In the embodiment of FIG. 6, drinking vessel 110 is generally similar in other respects to vessel 10 of FIG. 1. Vessel 110 has a handle 112, an opaque floor 114, a liquid receptacle 116 having a lateral wall 118, and a liquid chamber 122. Liquid chamber 122 is closed at the bottom by opaque panel 132 and at the top by transparent panel 130. Rotatable disc 126, which is rotatably mounted on pivot pin 134, is generally identical to disc 26 of FIG. 3, in particular bearing indicia 20B, indicia 20C and weight 38 (see FIG. 3). However, disc 126 is located in a disc chamber 129 located above and vertically aligned with liquid chamber 122. Vertical alignment, as employed herein, signifies that both chambers 122 and 129 will fall within the line of sight of a person peering into receptacle 116. Disc chamber 129 is closed by a transparent cover 131. Indicia corresponding to 20A (see FIG. 3) is disposed upon cover 131.

The purpose of the alternative embodiment is to separate disc 126 and pin 134 from liquid 136, where separation is desirable in order to prevent degradation of disc 126 and its indicia and pin 134, should liquid 136 be of reactive nature or otherwise prone to interfere with visibility or operation of the invention.

The present invention may be modified without departing from the inventive concept. For example, relative positions of chambers 122 and 129 may be reversed from the embodiment illustrated. Also, indicia corresponding to 20A and 20C may be disposed upon panel 132 or even another member (not shown), provided that the visual effect is similar to those of the illustrated embodiments. Discs 26 and 126 may be constrained to rotate by means other than by respective pivot pins 34, 134.

It is to be understood that the present invention is not limited to the embodiments described above, but encompasses any and all embodiments within the scope of the following claims.

I claim:

1. A novelty drinking vessel comprising:

a liquid receptacle having a lateral wall, a transparent floor, and a closed fluid chamber disposed within said transparent floor and said lateral wall; and a simulated display of an actual artificial horizon instrument, said display contained within said drinking vessel such that said display is visible from said liquid receptacle, said display comprising A fluid chamber and colored liquid disposed within and partially filling said fluid chamber, and a solid member rotatably contained within said drinking vessel, said drinking vessel dimensioned and configured to surround said solid member and to constrain said solid member to be disposed generally parallel to said floor of said liquid receptacle, said solid member indicia simulating indicia of a display of an actual artificial horizon instrument inscribed thereon, and a ballast weight disposed to maintain said solid member in an upright orientation.

2. The novelty drinking vessel according to claim 1, wherein said indicia has first indicia elements simulating the scale of an actual artificial horizon instrument, and second indicia elements simulating an aircraft symbol of an actual artificial horizon instrument.

3. The novelty drinking vessel according to claim 1, wherein said solid member is a disc having a periphery and wherein said indicia includes a pointer disposed at said periphery of said disc.

4. The novelty drinking vessel according to claim 1, wherein said drinking vessel has a handle fixed exteriorly thereto.

5. The novelty drinking vessel according to claim 1, wherein said solid member is a disc having a center point, and said novelty drinking vessel includes a pivot pin fixed to said floor, said pivot pin disposed to engage said solid member at said center point in a manner enabling said disc to rotate about said center point.

6. The novelty drinking vessel according to claim 1, wherein said solid member is rotatably contained within said fluid chamber.

7. The novelty drinking vessel according to claim 1, further comprising a disc chamber having a top and a bottom, a first transparent panel covering said disc chamber at said top of said disc chamber, and a second transparent panel covering said disc chamber at said bottom of said disc chamber, wherein said disc chamber is vertically aligned with said fluid chamber, and wherein said solid member is contained within said disc chamber.

8. A novelty drinking vessel comprising:

a liquid receptacle having a handle fixed exteriorly thereto, a lateral wall, and a transparent floor, said receptacle having a closed fluid chamber and a disc chamber disposed within said transparent floor and said lateral wall; and a simulated display of an artificial horizon instrument, comprising colored liquid disposed within and partially filling said fluid chamber, and a solid disc rotatably contained within said disc chamber, said floor of said disc chamber dimensioned and configured to surround said disc and to constrain said disc to be disposed generally parallel to said floor of said liquid receptacle, said disc bearing indicia inscribed thereon, said indicia having first indicia elements simulating the scale of an actual artificial horizon, thereby providing a visual field of reference, second indicia elements simulating an aircraft symbol of an actual artificial horizon instrument, and a pointer, and a ballast weight disposed to maintain said solid member in an upright orientation, wherein said disc has a periphery and a center point, wherein said pointer is disposed at said periphery of said disc, and wherein said novelty drinking vessel includes a pivot pin fixed to said floor, said pivot pin disposed to engage said disc at said center point in a manner enabling said disc to rotate about said center point.

* * * * *